US005829075A

United States Patent [19]

Stewart, Jr.

[11] Patent Number: 5,829,075

[45] Date of Patent: Nov. 3, 1998

[54] ADJUSTABLE FOUNDATION FOR USE WITH A BED FRAME

[75] Inventor: William C Stewart, Jr., Okolona, Miss.

[73] Assignee: Ark-Ell Springs, Incorporated, Houlka, Miss.

[21] Appl. No.: 764,227

[22] Filed: Dec. 13, 1996

[51] Int. Cl.[6] ..... A47C 20/14

[52] U.S. Cl. ..... 5/202; 5/617; 297/356

[58] Field of Search ..... 5/200.1, 202, 614, 5/617, 47; 297/356, 370, 371, 372

[56] References Cited

U.S. PATENT DOCUMENTS

| | | | |
|---|---|---|---|
| 1,008,107 | 11/1911 | Barnett . | |
| 1,044,280 | 11/1912 | Sontheimer | 5/47 |
| 1,394,985 | 10/1921 | Fischer | 5/617 |
| 2,501,464 | 3/1950 | Benstein | 5/47 |
| 2,651,054 | 9/1953 | Krakauer | 5/47 |
| 2,755,487 | 7/1956 | Harman | 5/47 X |
| 3,581,320 | 6/1971 | Degen | 5/617 X |
| 3,646,621 | 3/1972 | Fragas | 5/617 |
| 3,840,909 | 10/1974 | Detko . | |
| 3,854,154 | 12/1974 | Degen . | |
| 4,751,755 | 6/1988 | Carey, Jr. et al. . | |
| 5,425,150 | 6/1995 | Palmer, Jr. et al. . | |

*Primary Examiner*—Michael F. Trettel
*Attorney, Agent, or Firm*—Walker, McKenzie & Walker, P.C.

[57] ABSTRACT

An adjustable foundation for use with a bed frame. The foundation includes a base part and an adjustable head end part. One or preferably a pair of improved hinges hingeably attach the head end part to the base part. Each of the hinges includes a first mounting plate and a second mounting plate pivotally connected to the first mounting plate, a hinge latch, a trigger pivotally attached to the hinge latch, and a catch fixedly attached to the second mounting plate. During the raising of the head end part the catch enters a selected one of the notches in the lower edge of the hinge latch to hold the head end part at a selected fixed raised position. When it is desired to lower the head end part the head end part is raised beyond the highest fixed raised position, which causes the catch to engage a trigger notch wherein the trigger establishes a lowering position for lowering the head end part. The distance from the pivot axis of the trigger to the trigger notch is greater than the pivot axis of the trigger to the lower edge of the hinge latch so that lowering of the head end part with the trigger in the lowering position will cause the trigger to raise the lower edge of the hinge latch above the catch and bypass the hinge latch notches.

6 Claims, 2 Drawing Sheets

ADJUSTABLE FOUNDATION FOR USE WITH A BED FRAME

BACKGROUND OF THE INVENTION

1. Field of the Invention

The present invention relates, in general, to an adjustable foundation for use with a bed frame.

2. Information Disclosure Statement

It is often desired to have a bed structure in which the head supporting portion or head end part is adjustable to provide a choice of multiple positions of the head end part so that a person can adjust the angle of the head end part as desired to a selected position, for example, to a position for reading in bed, for watching television, etc. One attempted solution previously contemplated in the prior art comprised a mattress structure including a swingable head supporting portion which is held in different inclined positions by a slidable latch element that engages a selected notch. In this previous adjustable bed structure there are two springs acting on the latch element, namely (1) a coil spring which urges the latch element into engagement with the selected notch, and (2) a leaf spring. When it is desired to lower the headrest from any inclined position to a horizontal position, the headrest is pulled upwardly beyond the inclined positions and the leaf spring urges the latch element against a cam so that the latch element is deflected laterally and towards the pivot axis of the headrest whereby the latch element cannot engage the notches during the downward movement of the headrest to the horizontal position.

The above mentioned adjustable bed structure had various shortcomings, as will be apparent from the above description thereof. Thus, there is the additional manufacturing costs of providing the coil spring and the leaf spring. Also, it is more complicated than the present invention and there is the possibility of the device becoming jammed.

It is therefore desirable to have, in an adjustable bed foundation, a simpler, more economical and more effective device for holding the head end part at a selected position, and for subsequently permitting lowering of the head end part to a horizontal position.

A preliminary patentability search in Class 5, subclasses 202, 613, 614, and 617, produced the following patents, some of which may be relevant to the present invention: Barnett, U.S. Pat. No. 1,008,107, issued Nov. 7, 1911; Degen, U.S. Pat. No. 3,581,320, issued Jun. 1, 1971; Fragas, U.S. Pat. No. 3,646,621, issued Mar. 7, 1972; Detko, U.S. Pat. No. 3,840,909, issued Oct. 15, 1974; Degen, U.S. Pat. No. 3,854,154, issued Dec. 17, 1974; Carey, Jr., et al, U.S. Pat. No. 4,751,755, issued Jun. 21, 1988; and Palmer, Jr., et al, U.S. Pat. No. 5,425,150, issued Jun. 20, 1995.

SUMMARY OF THE INVENTION

The present invention is an improved hinge in an adjustable foundation for use with a bed frame, which is economical to manufacture, which is simpler in construction than previous hinges of this general type, is very effective in its operation in holding the head end part of the adjustable foundation at a selected position, and for subsequently permitting lowering of the head end part to a horizontal position.

It is an object of the present invention to provide an improved hinge in an adjustable foundation that includes a unique hinge latch, trigger, and catch means combination in which the catch means slidably contacts and relatively moves along the lower edge of the hinge latch as the head end part of the adjustable foundation is moved from a lowered position towards raised positions and the catch means enters a selected one of the hinge latch notches in the hinge latch to hold the head end part in a corresponding selected raised position. Then, subsequent selected relative movement of the catch means past the hinge latch notches and into a trigger notch causes the trigger to establish a lowering position for lowering the head end part in which the catch means and trigger combination lifts the hinge latch during lowering of the head end part to bypass the hinge latch notches.

A further object is to provide such an improved hinge in which is included actuating means attached to the hinge latch for being engaged by the forward edge of the trigger at a point during the lowering of said head end part when the head end part is adjacent the lowered position thereof, whereby further lowering of the head end part causes the actuating means to move the trigger rearwardly relative to the catch means so that the catch means becomes disengaged from the trigger notch and the trigger assumes the reset position and the hinge is reset for subsequent movement of the head end part towards raised positions.

A further object is to provide an adjustable foundation including counterbalance means for providing ease in lifting the head end part and for preventing the head part from slamming down against the base part of the adjustable bed foundation when the head part is lowered.

DESCRIPTION OF THE PREFERRED EMBODIMENT

Figure 2:
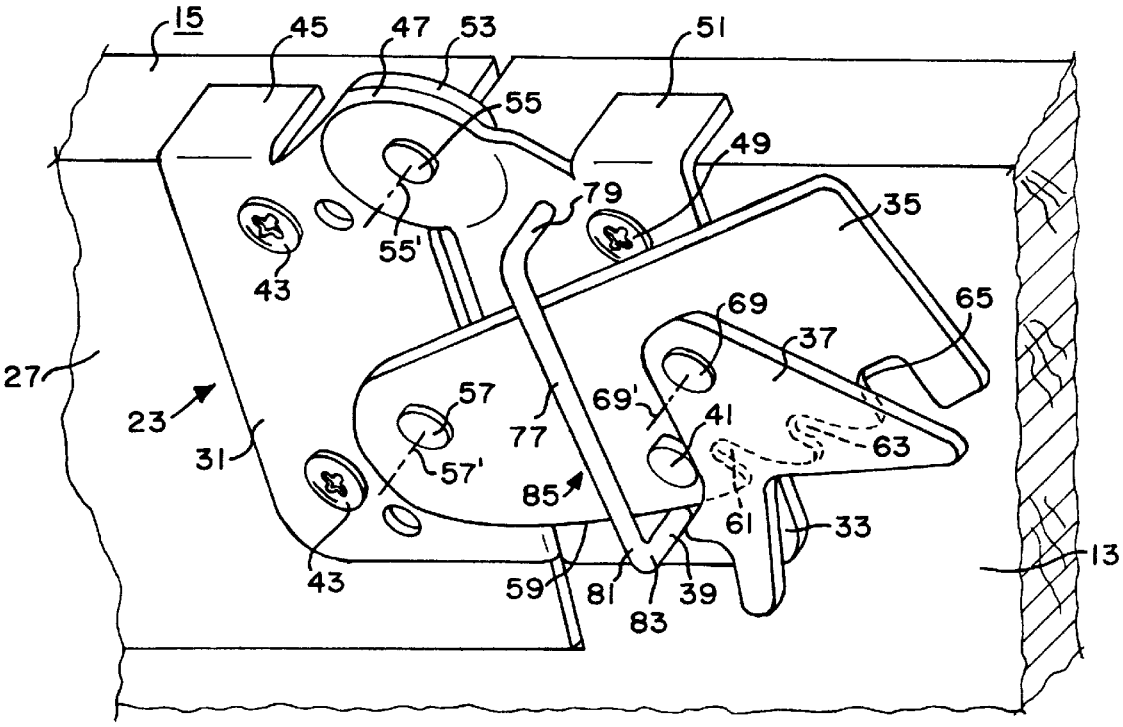
FIG. 2 is an enlarged fragmentary view of a portion of that shown in FIG. 1 and with the head end part of the bed foundation and the hinge of the present invention shown in a lowered or horizontal position.

Referring now to the drawings, the adjustable foundation 11 of the present invention is intended to replace the box spring foundation, not shown, in a conventional set of bedding, i.e., mattress and box spring set. Foundation 11 is dimensioned to be installed in any bed frame in which a similar size conventional box spring can be installed. The frame of foundation 11 comprises, in general, two basic parts, i.e., a base part 13 and an adjustable head end part 15. Sinuous springs 17 are attached to the sides of foundation 11 along the entire length of the foundation. Foundation 11 includes wood or steel braces 19, as required. A gas spring 21 of suitable construction, which is preferably model No. SL-38 manufactured by Spring Lift Corp. of Monticello, Ark., is pivotally connected at the opposite ends thereof respectively to head end part 15 and to one of the braces 19 of base part 13 for providing aid in lifting head end part 15 and for preventing head end part 15 from slamming down against base part 13 when the head end part 15 is lowered. Base part 13 is preferably cut-out or shaped as at 20 adjacent the head or forward end of the base part 13 to accommodate head end part 15 so that when head end part 15 is in a lowered or horizontal position as shown in FIG. 2 the top edges of the head end part 15 and the top edges of the base part 13 are at the same level. Preferably, foundation 11 is appropriately upholstered with suitable padding etc. using fabric to match the mattress fabric. It will be understood that a suitable mattress, not shown, is placed on top of foundation 11 to make a complete bed for use.

Figure 1:
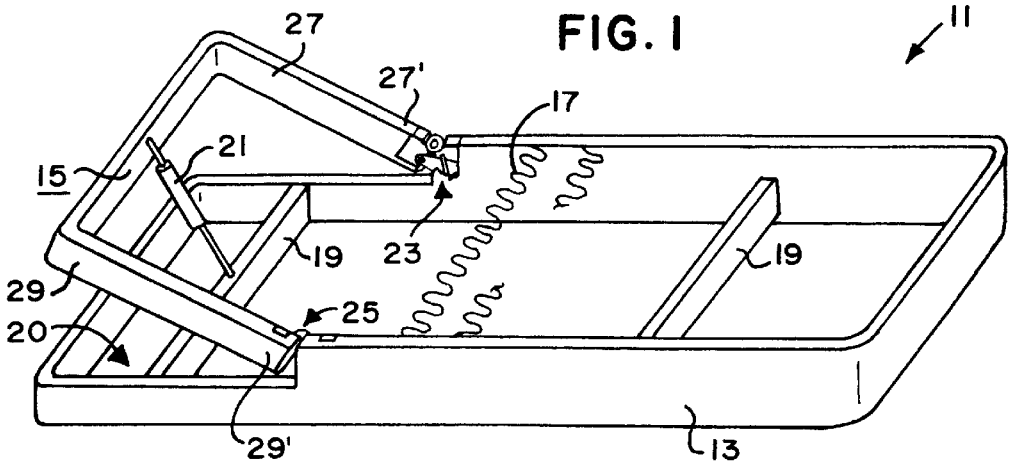
FIG. 1 is a perspective view of the present invention configured with an adjustable bed foundation.

Adjustable head part 15 is preferably hingedly attached to base part 13 by the improved hinges 23, 25 of the present invention which respectively extend between and connect the ends 27', 29' of legs 27, 29 of head part 15 with base part 13. It will be understood that if desired only one of the hinges 23, 25 of the present invention may be utilized and the other hinge may be of any other suitable construction without departing from the spirit and scope of the present invention. However, as above stated, adjustable head part 15 is preferably hingedly attached to base part 13 by both hinges 23, 25. Hinges 23, 25 are both of the same construction except one is preferably a right hand hinge and the other is a left hand hinge so that the parts of both of the hinges 23, 25 will be facing the inside of base part 13 as best seen in FIG. 1. Therefore, the following description of hinge 23 should suffice for both hinges 23, 25.

Hinge 23 includes, in general, a first mounting plate 31, a second mounting plate 33, a hinge latch 35, a trigger 37, a catch or catch means 39, and an actuator or actuating means 41.

First mounting plate 31 is fixedly attached to leg 27 of head end 15 by suitable means, such as screws or bolts 43. First mounting plate 31 includes a tab 45 extending perpendicular from the main body portion of first mounting plate 31 and contacting the upper edge of leg 27. Also, first mounting plate 31 includes a projection 47 extending upwardly and rearwardly from the main body portion of first mounting plate 31.

Second mounting plate 33 is fixedly attached to base part 13 by suitable means, such as screws or bolts 49. Second mounting plate 33 includes a tab 51 extending perpendicular from the main body portion of second mounting plate 33 and contacting the upper edge of base part 13. Also, second mounting plate 33 includes a projection 53 extending upwardly and forwardly from the main body portion of second mounting plate 33.

Projection 47 of first mounting plate 31 and projection 53 of second mounting plate 33 are disposed in overlapping relationship and a suitable first pivot means or pivot pin 55 having a pivot axis 55' is fixedly attached to projection 47 and extends through an aperture, not shown, in projection 53 to pivotally interconnect first mounting plate 31 and second mounting plate 33 and thus pivotally attach head end part 15 to base part 13 for movement of head end part 15 between a lowered position as seen in FIG. 2 and raised positions. A head is preferably provided on the end of pin 55 to retain projections 47, 53 on pin 55.

A suitable second pivot means or pivot pin 57 having a pivot axis 57' is fixedly attached to first mounting plate 31 and extends therefrom through an aperture, not shown, in hinge latch 35 to pivotally attach hinge latch 35 to first mounting plate 31 for pivot about pivot pin 57 and pivot pin axis 57'. A head is preferably provided on the end of pin 57 to retain hinge latch 35 on pin 57.

The lower edge 59 of hinge latch 35 is provided with a plurality of hinge latch notches, i.e., preferably as follows: a first or proximal hinge latch notch 61 corresponding to a first fixed position of head end part 15, a second or intermediate hinge latch notch 63 corresponding to a second fixed position of head end part 15, and a third or distal hinge latch notch 65 corresponding to a third fixed position of head end part 15. Proximal notch 61 has a rounded seating portion 61' and a sloping portion 61" that slops downwardly from the rounded seating portion 61'. Intermediate notch 63 likewise has a rounded seating portion 63' and a sloping portion 63" that slopes downwardly from the rounded seating portion 63'. Distal notch 65 has a rounded seating portion 65', but is extended lengthwise to provide an extended portion as at 67 for a purpose to be described later in the specification.

A suitable third pivot means or pivot pin 69 having a pivot axis 69' is fixedly attached to hinge latch 35 and extends therefrom through an aperture, not shown, in trigger 37 to suspend trigger 37 from hinge latch 35 for pivot of trigger 37 about pivot axis 69'. A head is preferably provided on the end of pin 69 to retain trigger 37 on hinge latch 35.

Trigger 37 is provided with a counterweight preferably in the form of an outwardly extending portion 71 that urges trigger 37 in a clockwise direction about pivot pin 69 and towards catch 39. Trigger 37 is provided with a trigger notch 73 in the forward edge 75 of trigger 37.

Catch 39 is fixedly attached to second mounting plate 33 as by welding or the like and projects perpendicularly outwardly from second mounting plate 33. Catch 39 is preferably cylindrical in shape.

An elongated bracket 77 having an inturned upper end 79 and a depending lower end 81 is fixedly attached at the upper end 79 to second mounting plate 33 as by welding or the like. Elongated bracket 77 extends in spaced relationship over hinge latch 35 and is integrally attached at the lower end 81 thereof to the outer end 83 of catch 39 to establish a U-shaped member 85 that prevents upholstery, bedding and the like from being caught in parts of hinge 23, particularly catch 39, that otherwise might occur if elongated bracket 77 was not connected to catch 39. Also, U-shaped member 85 limits counterclockwise movement of hinge latch 35.

Foundation 11 can be constructed of any suitable material, as for example, base part 13 and head end part 15 can be constructed of wood or steel whereas hinges 23, 25 are preferably constructed of steel.

Figure 3:
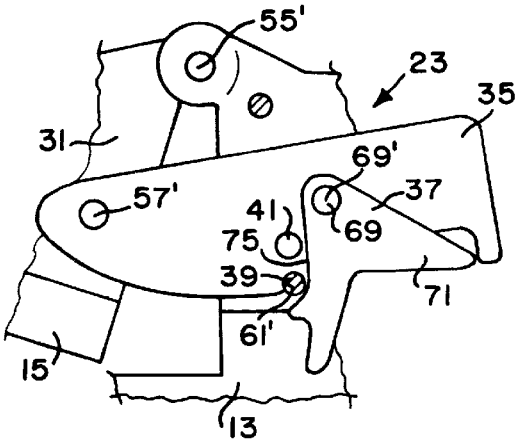
FIG. 3 is a fragmentary and somewhat schematic side elevational view of a portion of that shown in FIG. 1 and with the head end part of the bed foundation and the hinge of the present invention shown in a first fixed raised position.

In describing the operation of foundation 11, it will be assumed that the starting position of the head end part 15 and hinges 23, 25 are in the lowered or horizontal position best seen in FIG. 2. The operation of each of the hinges 23, 25 is the same and the following description of the operation of hinge 23 should suffice for both. When it is desired to raise head end part 15 to one of the raised positions, head end part 15 is manually moved upwardly by pulling upwardly on the end of the head end part 15 to pivot the head end part about the pivot axis 55' of hinge 23. As head end part 15 is raised, first mounting plate 31 is pivoted clockwise as viewed FIG. 2 which by means of second pivot pin 57 pulls hinge latch 35 forwardly, i.e., to the left as viewed in FIG. 2, to cause the lower edge 59 of hinge latch 35 to slide along catch 39. In other words, catch means 39 slidably contacts and relatively moves along the lower edge 59 of latch 35. During this relative movement catch 39 contacts trigger 37 to push trigger 37 and cause the trigger to pivot in a counterclockwise direction about pivot pin 69. This motion continues until trigger 37 clears the first or proximal hinge latch notch 61. When this occurs hinge latch 35 drops down, i.e., pivots clockwise, so that catch 39 enters first latch notch 61 and is seated in seating portion 61'. Head end part 15 is now effectively locked in a first fixed position best seen in FIG. 3.

Figure 4:
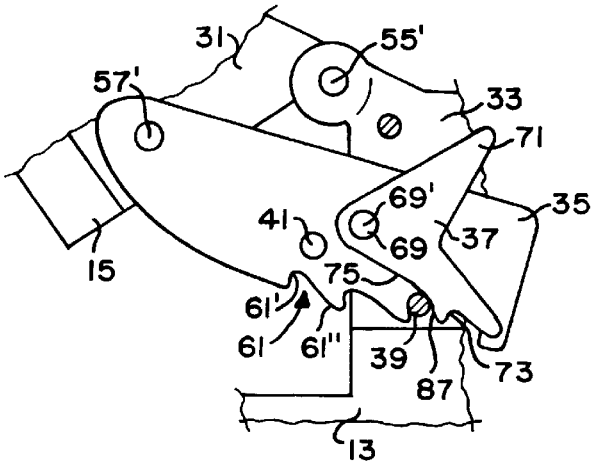
FIG. 4 is a view similar to FIG. 3 but with the head end part of the bed foundation and the hinge of the present invention shown in a third or highest fixed raised position.

By raising head end part 15 even further, in substantially the same manner as above described relative to first notch 61 catch 39 may be selectively caused to enter second latch notch 63 or third latch notch 65, to thereby effectively lock head end part 15 in a second fixed position or a third fixed position. It will be understood that in going from said first fixed position to said second fixed position, catch 39 will slidably contact and relatively move along sloping portion 61" and into second latch notch 63 for seating in seating portion 63', and in going from said second fixed position to said third fixed position catch 39 will slidably contact and relatively move along sloping portion 63" and into third latch notch 65 for seating in seating portion 65'. FIG. 4 shows the head end part 15 locked in said third fixed position.

Figure 5:
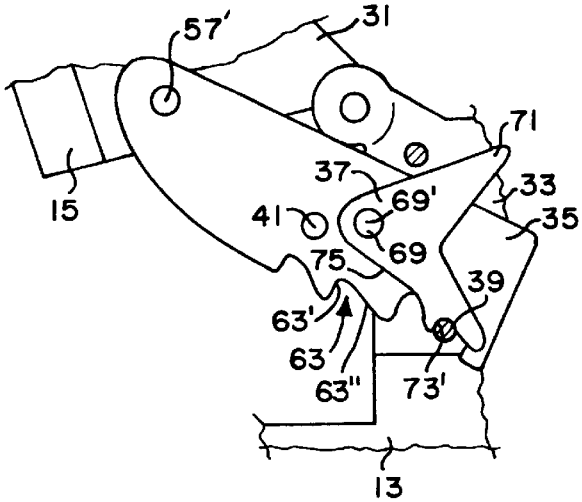
FIG. 5 is a view similar to FIG. 3 but with the head end part of the bed foundation and the hinge of the present invention shown in a position ready for lowering.
Figure 6:
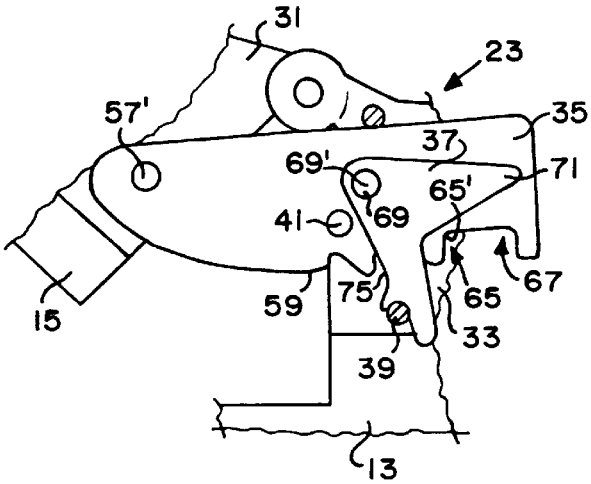
FIG. 6 is a view similar to FIG. 3 but with the head end part of the bed foundation and the hinge of the present invention shown in one of the positions through which the head end part and the hinge pass during the lowering thereof.

To lower head end part 15 back to said lowered position from said third fixed position the following sequence of events takes place: Assuming head end part 15 is in said third fixed position the head end part 15 is raised further so that catch 39 enters the extended portion 67 of latch notch 65, whereupon catch 39 relatively and slidingly moves along the portion 87 of the forward edge 75 of trigger 37 until the entrance of trigger notch 73 is reached by catch 39. When this occurs trigger 37 drops down, i.e., pivots clockwise, so that catch 39 enters trigger notch 73 and is seated in seating portion 73'. Trigger 37 is now in a lowering position best seen in FIG. 5 ready for the lowering of head end part 15 to take place. It will be understood that when the head end part is released and begins to lower, trigger 3 7 raises hinge latch 35 slightly thus allowing the hinge latch notches 65, 63, and 61 to by-pass catch 39 as head end part 15 is lowered. FIG. 6 shows the relationship of the parts of hinge 23 in one of its positions during lowering. It will be understood that the distance from the pivot axis 69' of trigger 37 to trigger notch 73 is greater than the distance from the pivot axis 69' of trigger 37 to lower edge 59 of hinge latch 35 so that the lowering of head end part 15 with trigger 37 in the lowering position will cause trigger 37 to raise lower edge 59 of hinge latch 35 above the catch 39 and vault hinge latch 35 and the notches 65, 63, and 61 over catch 39 whereby the notches 65, 63, and 61 are bypassed. Then, when head end part 15 is lowered to a point at which head end part 15 is near but spaced from said lowered position, actuating means 41, which is fixedly mounted on hinge latch 35 and projects outwardly therefrom, is contacted by trigger 37 to substantially stop clockwise pivoting movement of trigger 37 about third pivot axis 69'. Further lowering movement of head end part 15 causes actuating means 41 to move trigger 37 rearwardly relative to catch 39 so that catch 39 becomes disengaged from trigger notch 73 and trigger 37 assumes the reset position shown in FIG. 2 whereby hinge 23 is reset for subsequent movement of head end part 15 towards said raised positions heretofore described.

It should be understood that more or less latch notches may be provided in hinge latch 35 without departing from the spirit and scope of the present invention.

Although the present invention has been described and illustrated with respect to a preferred embodiment and a preferred use therefor, it is not to be so limited since modifications and changes can be made therein which are within the full intended scope of the invention.

I claim:

1. In an adjustable bed foundation of the type including a base part and an adjustable head end part, an improved hinge hingeably attaching said base part to said head end part, said hinge comprising:

(a) first mounting plate fixedly attached to said head end part and a second mounting plate fixedly attached to said base end part;

(b) first pivot means, pivotally interconnecting said first mounting plate and said second mounting plate, to pivotally attach said head end part to said base part for movement of said head end part between a lowered position and at least one raised position;

(c) a hinge latch having a lower edge provided with at least one hinge latch notch;

(d) second pivot means pivotally attaching said hinge latch to said first mounting plate;

(e) a trigger including a forward edge, said trigger having a trigger notch provided in said forward edge;

(f) third pivot means pivotally suspending said trigger means from said hinge latch;

(g) catch means, fixedly attached to said second mounting plate, for slidably contacting and relatively moving along said lower edge of said hinge latch as said head end part is moved from said lowered position towards said raised position and for entering said hinge latch notch to hold said head end part in a fixed position; and for subsequent selected movement past said hinge latch notch and into said trigger notch wherein said trigger establishes a lowering position for lowering said head end part; and for raising said trigger to lift said hinge latch above said catch means during lowering of said head end part to bypass said hinge latch notch; and (h) actuating means attached to said hinge latch for engaging said forward edge of said trigger during lowering of said head end part and for pushing said trigger to disengage said trigger notch from said catch means and reset said hinge for subsequent movement of said head end part towards said raised position.

2. In an adjustable bed foundation of the type including a base part and an adjustable head end part having selectable fixed positions, an improved hinge hingeably attaching said base part to said head end part, said hinge comprising:

(a) a first mounting plate fixedly attached to said head end part and a second mounting plate fixedly attached to said base end part;

(b) first pivot means, pivotally interconnecting said first mounting plate and said second mounting plate, to pivotally attach said head end part to said base part for movement of said head end part to one of said selectable fixed positions between a lowered position and raised positions;

(c) a hinge latch having a lower edge provided with a plurality of hinge latch notches corresponding with said selectable fixed positions of the head end part, said plurality of hinge latch notches including at least a proximal hinge latch notch corresponding with a first fixed raised position of the head end part and a distal hinge latch notch corresponding with a highest fixed raised position of the head end part;

(d) second pivot means pivotally attaching said hinge latch to said first mounting plate;

(e) a trigger including a forward edge, said trigger having a trigger notch provided in said forward edge;

(f) third pivot means pivotally suspending said trigger means from said hinge latch; and (g) catch means, fixedly attached to said second mounting plate, for slidably contacting and relatively moving along said lower edge of said hinge latch as said head end part is moved from said lowered position towards said raised positions; for successively entering said respective hinge latch notches to hold said head end part in one of the selectable fixed positions; and for subsequent selected movement past said distal notch and into said trigger notch wherein said trigger establishes a lowering position for lowering said head end part, the distance from said third pivot means to said trigger notch being greater than the distance from said third pivot means to said lower edge of said hinge latch so that lowering said head end part with said trigger in said lowering position will cause said trigger to raise said lower edge of said latch means above said catch means and bypass said hinge latch notches.

3. The apparatus of claim 2 in which said plurality of hinge latch notches includes an intermediate hinge latch notch disposed between said proximal hinge latch notch and said distal hinge latch notch and corresponding with an intermediate fixed raised position of the head end part between said first position of the head end part and said highest fixed raised position of the head end part.

4. The apparatus of claim 2 in which is included actuating means attached to said hinge latch for engaging said forward edge of said trigger during lowering of said head end part and for pushing said trigger to disengage said trigger notch from said catch means and reset said hinge for subsequent movement of said head end part towards said raised positions.

5. A hinge for use in an adjustable bed foundation of the type including a base part and an adjustable head end part, said hinge comprising:

(a) a first mounting plate means for fixed attachment to said head end part and a second mounting plate means for fixed attachment to said base end part;

(b) first pivot means, pivotally interconnecting said first mounting plate means and said second mounting plate means for pivotally attaching said head end part to said base part for movement of said head end part between a lowered position and at least one raised position;

(c) a hinge latch having a lower edge provided with at least one hinge latch notch;

(d) second pivot means pivotally attaching said hinge latch to said first mounting plate;

(e) a trigger including a forward edge, said trigger having a trigger notch provided in said forward edge;

(f) third pivot means pivotally suspending said trigger means from said hinge latch;

(g) catch means, fixedly attached to said second mounting plate means, for slidably contacting and relatively moving along said lower edge of said hinge latch as said head end part is moved from said lowered position towards said raised position and for entering said hinge latch notch to hold said head end part in a fixed position; and for subsequent selected movement past said hinge latch notch and into said trigger notch wherein said trigger establishes a lowering position for lowering said head end part; and for raising said trigger to lift said hinge latch above said catch means during lowering of said head end part to bypass said hinge latch notch; and (h) actuating means attached to said hinge latch for engaging said forward edge of said trigger during lowering of said head end part and for pushing said trigger to disengage said trigger notch from said catch means and reset said hinge for subsequent movement of said head end part towards said raised position.

6. A hinge for use in an adjustable bed foundation of the type including a base part and an adjustable head end part, said hinge comprising:

(a) a first mounting plate means for fixed attachment to said head end part and a second mounting plate means for fixed attachment to said base end part;

(b) first pivot means, pivotally interconnecting said first mounting plate means and said second mounting plate means for pivotally attaching said head end part to said base part for movement of said head end part between a lowered position and at least one raised position;

(c) a hinge latch having a lower edge provided with at least one hinge latch notch;

(d) second pivot means pivotally attaching said hinge latch to said first mounting plate;

(e) a trigger including a forward edge, said trigger having a trigger notch provided in said forward edge;

(f) a third pivot means pivotally suspending said trigger means from said hinge latch;

(g) catch means, fixedly attached to said second mounting plate means, for slidably contacting and relatively moving along said lower edge of said hinge latch as said head end part is moved from said lowered position towards said raised position and for entering said hinge latch notch to hold said head end part in a fixed position; and for subsequent selected movement past said hinge latch notch and into said trigger notch wherein said trigger establishes a lowering position for lowering said head end part; and for raising said trigger to lift said hinge latch above said catch means during lowering of said head end part to bypass said hinge latch notch;

(h) actuating means attached to said hinge latch for engaging said forward edge of said trigger during lowering of said head end part and for pushing said trigger to disengage said trigger notch from said catch means and reset said hinge for subsequent movement of said head end part towards said raised position; and (i) counterbalancing means interposed between the head end part and the base part of the bed foundation for providing aid in lifting the head end part and for preventing the head end part from slamming down against the base part of the adjustable bed foundation when the head end part is lowered.

* * * * *